US006840592B2

(12) United States Patent
Kalieta et al.

(10) Patent No.: US 6,840,592 B2
(45) Date of Patent: Jan. 11, 2005

(54) DRINKING GLASS DISPLAY AND STORAGE CABINET

(76) Inventors: Leo A. Kalieta, 20 Middlesex Rd., Matawan, NJ (US) 07747; Nancy J. Kalieta, 20 Middlesex Rd., Matawan, NJ (US) 07747

( * ) Notice: Subject to any disclaimer, the term of this patent is extended or adjusted under 35 U.S.C. 154(b) by 0 days.

(21) Appl. No.: 10/342,526

(22) Filed: Jan. 16, 2003

(65) Prior Publication Data

US 2004/0140744 A1 Jul. 22, 2004

(51) Int. Cl.[7] ..... A47F 3/00; A47F 3/06; A47F 3/08; A47G 29/00; E05F 1/02

(52) U.S. Cl. ..... 312/326; 312/114; 312/138.1; 312/126; 312/128; 211/71.01; 211/74; 211/90.01; 211/90.02; 248/250; 16/312

(58) Field of Search ..... 16/316, 312; 211/74, 211/71.01, 90.01, 90.02, 187, 208; 312/326, 114, 138.1, 128, 126; 248/250

(56) References Cited

U.S. PATENT DOCUMENTS

| | | | | | |
|---|---|---|---|---|---|
| D22,731 | S | * | 8/1893 | Shoudy | 312/114 X |
| 852,769 | A | * | 5/1907 | Campbell | 312/138.1 X |
| 934,526 | A | * | 9/1909 | Heusser | 312/138.1 |
| 943,350 | A | * | 12/1909 | Holden | 312/128 X |
| 1,008,574 | A | * | 11/1911 | Weinstock | 312/114 |
| 1,011,112 | A | * | 12/1911 | Burlingame | 312/138.1 X |
| 1,161,189 | A | * | 11/1915 | Coleston | 312/126 |
| 1,188,974 | A | * | 6/1916 | Montgomery | 312/114 X |
| D67,413 | S | * | 5/1925 | Morris | 3121/114 X |
| 1,608,456 | A | * | 11/1926 | Abdonch | 312/128 |
| 1,638,863 | A | * | 8/1927 | Mabe | 312/114 |
| 2,023,356 | A | * | 12/1935 | Fain | 312/138.1 X |
| 2,046,398 | A | * | 7/1936 | McGowan | 312/138.1 X |
| 2,087,904 | A | * | 7/1937 | Flood | 312/114 |
| 2,266,580 | A | * | 12/1941 | Alheit | 312/138.1 X |
| 2,318,921 | A | * | 5/1943 | Bullard | 312/138.1 X |
| 2,443,515 | A | * | 6/1948 | Rockwell | 312/138.1 X |
| 2,681,262 | A | * | 6/1954 | Vincent | 312/128 X |
| 3,115,719 | A | * | 12/1963 | Mapson | 312/114 X |
| 3,306,689 | A | * | 2/1967 | Anson et al. | 312/128 X |
| 3,471,111 | A | * | 10/1969 | Macdonald | 248/250 X |
| 3,471,112 | A | * | 10/1969 | Macdonald et al. | 248/250 X |
| 3,584,927 | A | * | 6/1971 | Ott et al. | 312/128 X |
| 3,628,845 | A | * | 12/1971 | Grimm | 16/312 X |
| 3,668,737 | A | * | 6/1972 | Tillmann | 16/312 X |
| 4,008,810 | A | * | 2/1977 | Merz | 211/74 X |
| 4,037,813 | A | * | 7/1977 | Loui et al. | 248/250 |
| 4,053,132 | A | * | 10/1977 | Del Pozzo | 248/250 X |
| 4,073,556 | A | * | 2/1978 | Wilson, Jr. | 312/138.1 X |
| 4,287,641 | A | * | 9/1981 | MacDonald | 16/319 X |
| 4,432,523 | A | * | 2/1984 | Follows | 248/250 |
| 4,631,777 | A | * | 12/1986 | Takimoto | 16/312 X |
| 4,666,117 | A | * | 5/1987 | Taft | 248/250 X |
| 4,732,358 | A | * | 3/1988 | Hughes et al. | 248/250 X |
| 4,735,391 | A | * | 4/1988 | Lawrence | 211/90.01 X |
| 4,753,495 | A | * | 6/1988 | Swink | 312/114 |
| 4,819,901 | A | * | 4/1989 | McDonald | 248/250 |
| 4,886,327 | A | * | 12/1989 | Amstutz et al. | 312/114 X |
| 4,991,259 | A | * | 2/1991 | Finkelstein et al. | 16/312 |
| 5,195,708 | A | * | 3/1993 | Marsh | 248/250 |
| 5,265,311 | A | * | 11/1993 | Gard | 16/312 |
| 5,372,075 | A | * | 12/1994 | Graf | 312/128 X |
| 5,419,628 | A | * | 5/1995 | Myslinski et al. | 312/138.1 |
| 5,819,958 | A | * | 10/1998 | Dement | 211/90.01 |
| 5,832,562 | A | * | 11/1998 | Luca | 16/71 |
| 5,964,359 | A | * | 10/1999 | Marino, Jr. | 211/74 |
| 6,056,376 | A | * | 5/2000 | Yenglin et al. | 312/138.1 X |
| 6,065,724 | A | * | 5/2000 | Arslan et al. | 211/90.02 X |
| 6,113,198 | A | * | 9/2000 | Hommes | 312/114 |
| 6,186,456 | B1 | * | 2/2001 | Marsh | 248/250 X |
| 6,212,793 | B1 | * | 4/2001 | Goad | 211/71.01 X |
| 6,352,321 | B1 | * | 3/2002 | Munoz | 312/126 X |
| 6,363,993 | B1 | * | 4/2002 | Aquilina | 160/229.1 |
| 6,402,270 | B1 | * | 6/2002 | Frank | 312/138.1 |
| 6,513,888 | B1 | * | 2/2003 | Lucht | 312/138.1 |
| 6,631,812 | B2 | * | 10/2003 | Ruiz | 211/74 X |
| 2002/0171338 | A1 | * | 11/2002 | Wetterberg | 312/326 X |

FOREIGN PATENT DOCUMENTS

| | | | | | |
|---|---|---|---|---|---|
| FR | 2647327 | A1 | * | 11/1990 | 312/114 |
| GB | 2035783 | A | * | 6/1980 | 211/71.01 |
| JP | 02171368 | A | * | 7/1990 | 312/128 |

* cited by examiner

*Primary Examiner*—Rodney B. White
(74) *Attorney, Agent, or Firm*—Charles I. Brodsky

(57) ABSTRACT

A cabinet having a hinged, see-through door for viewing wine and like drinking glasses suspended from the underside of its top surface and shelves in an inverted upside-down orientation with internal illumination and with a self-sealing felt composition compressible inwardly when closing the door to seal out entry of dust.

7 Claims, 5 Drawing Sheets

DRINKING GLASS DISPLAY AND STORAGE CABINET

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the display and storage of drinking glasses, in general, and to a cabinet for the display and storage of wine glasses, in particular.

2. Description of the Related Art

As is well known and understood, wine connoisseurs frequently purchase mini-cellars for storing wine bottles at their proper temperature. Whatever their capacity—and whether they are provided with furniture casters, security locks, low heat display lights and with temperature and/or humidity controls—whole industries have been built to provide these types of cellars and racking to snugly fit into available space, whether stacked or customized as hand-crafted furniture pieces to look elegant in any setting. Available at costs upwards of thousands of dollars depending upon the wine storage technology involved and the furniture styling selected, the wide variety of products available serves to indicate just how far wine aficionados go in seeking quality wine storage at the lowest cost-per-bottle that could be afforded.

At the same time, purchasers of these mini-cellars realize that different wines are to be served with different style wine glasses—as, for example, between Bordeaux, Burgundy, Chardonnay, Sauvignon Blanc and Champagne. This follows by customizing the shape of the glass to the characteristics of each grape variety in order to allow the wine to achieve its fullest expression in enhancing the wine's flavor and bouquet. Whatever the shape the bowls may be, and whatever the styling of their slender stems, the wine glasses selected by these devotees all are chosen for the purpose of adding touches of elegance to the dining table.

Unfortunately, there is nowhere available any wine glass storage cabinet by which the elegance, lightness and balance of these glasses can be displayed.

SUMMARY OF THE INVENTION

As will become clear from the following description, such a wine glass display encasement embodying the invention addresses this absence by providing a cabinet having enclosed top, bottom, side and rear walls—and a see-through door hinged to the cabinet for respectively closing and opening it. With at least one horizontally aligned shelf within the cabinet extending between its side walls, first means are included secured to an underside of the top wall and to an underside of the shelf for supporting the flange of a succession of these wine glasses in an inverted upside-down orientation. In accordance with this embodiment, second means are secured to at least one edge surface of the see-through door for sealing the cabinet against the entry of dust once the door is closed.

In a preferred embodiment of the invention, third means are included along an inside surface of the rear cabinet wall for illuminating the inside of the cabinet and the glasses arranged therein when the see-through door is closed. This may be accomplished through the employment of a plastic encased rope-lighting extending both horizontally and vertically alongside the inside surface of the front wall. With a plurality of horizontally aligned shelves within the cabinet extending between its side walls, the securement of the wine glasses by their flanges in an inverted upside-down orientation would then be had by a securement to each of the underside of the top wall and to the underside of the various shelves employed. In such configuration, the various wine glasses may be arranged in rows extending forwardly from the rear wall, one row alongside the other. An automatically operating self-closing hinge is preferable for the respective closing and opening of the cabinet, while a felt composition compressible inwardly upon itself when closing the door is preferable as a manner of preventing dust from entering the cabinet once the door is closed. A pull-out drawer may then be included as part of the cabinet, extending forwardly of the rear wall between the cabinet's side walls, at a location adjacent to the bottom. As will be appreciated, corkscrews, wax scoopers, bottle stoppers, wine label removers and other accessories could be then stored in the drawer.

(While this invention is particularly suited for the display and storage of wine glasses of different bowl shape and stem configuration, it will be appreciated by those skilled in the art that its teachings apply equally as well for the display and storage of differently configured drinking glasses, as in crystal ware. For ease of description, the term "wine glass" will be employed in the description below to cover both these types of appearances.)

BRIEF DESCRIPTION OF THE DRAWINGS

These and other features of the present invention will be more clearly understood from a consideration of the following description, taken in connection with the accompanying Drawings, in which.

DETAILED DESCRIPTION OF THE INVENTION

Figure 1:
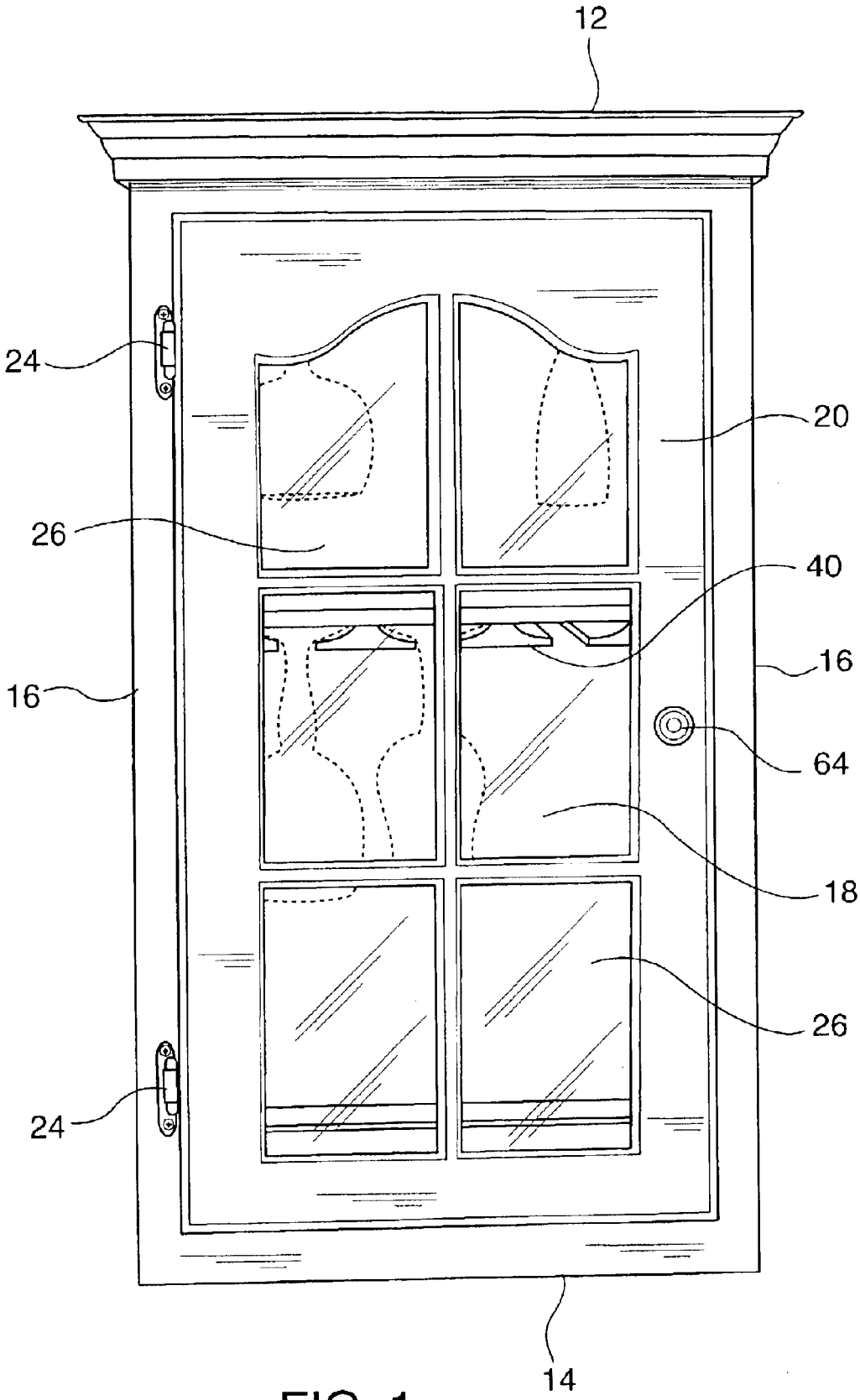
FIGS. 1 and 2 are front views of the display and storage cabinet of the invention as it would appear with its see-through door closed and opened, respectively.
Figure 2:
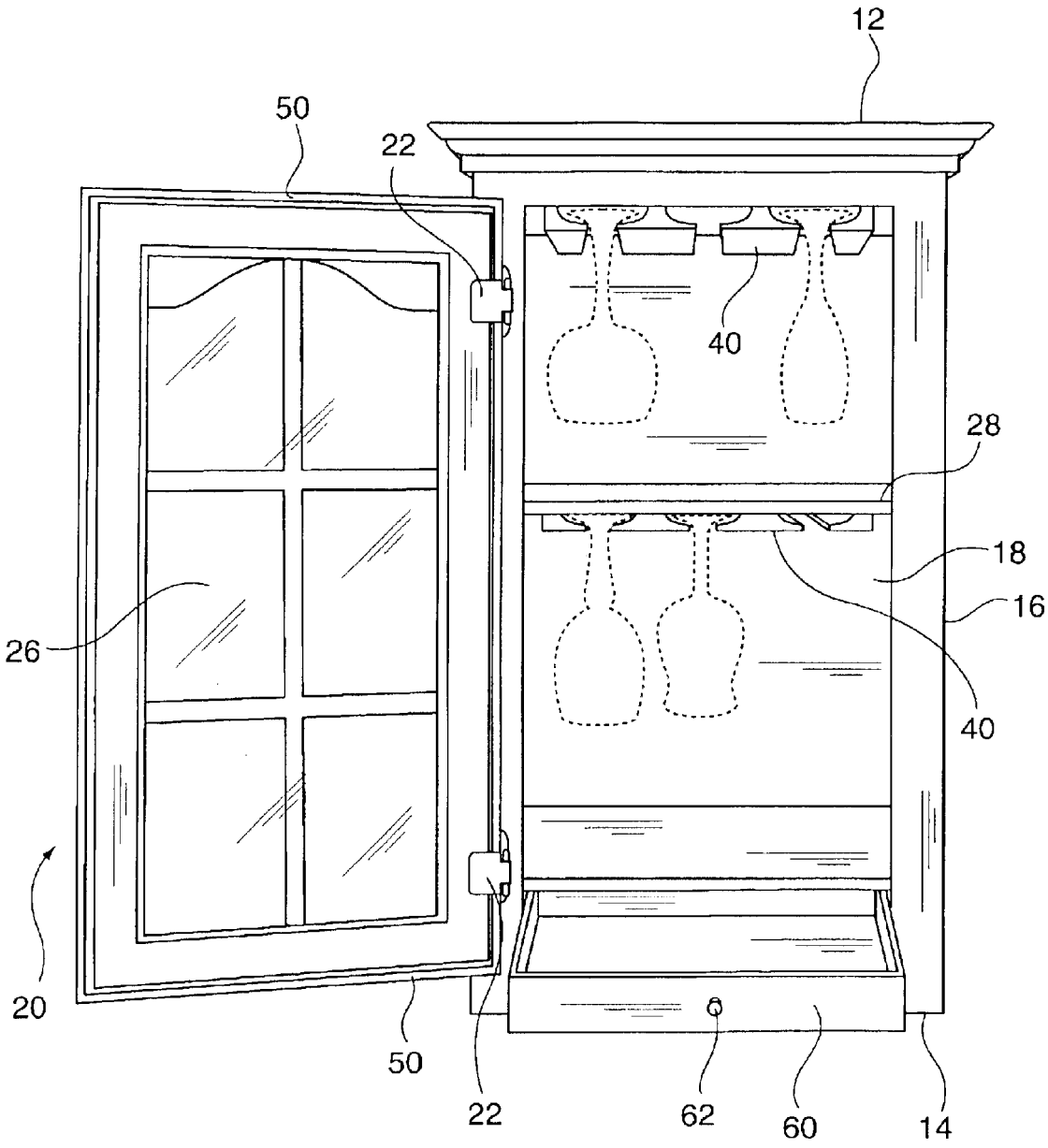
Figure 3:
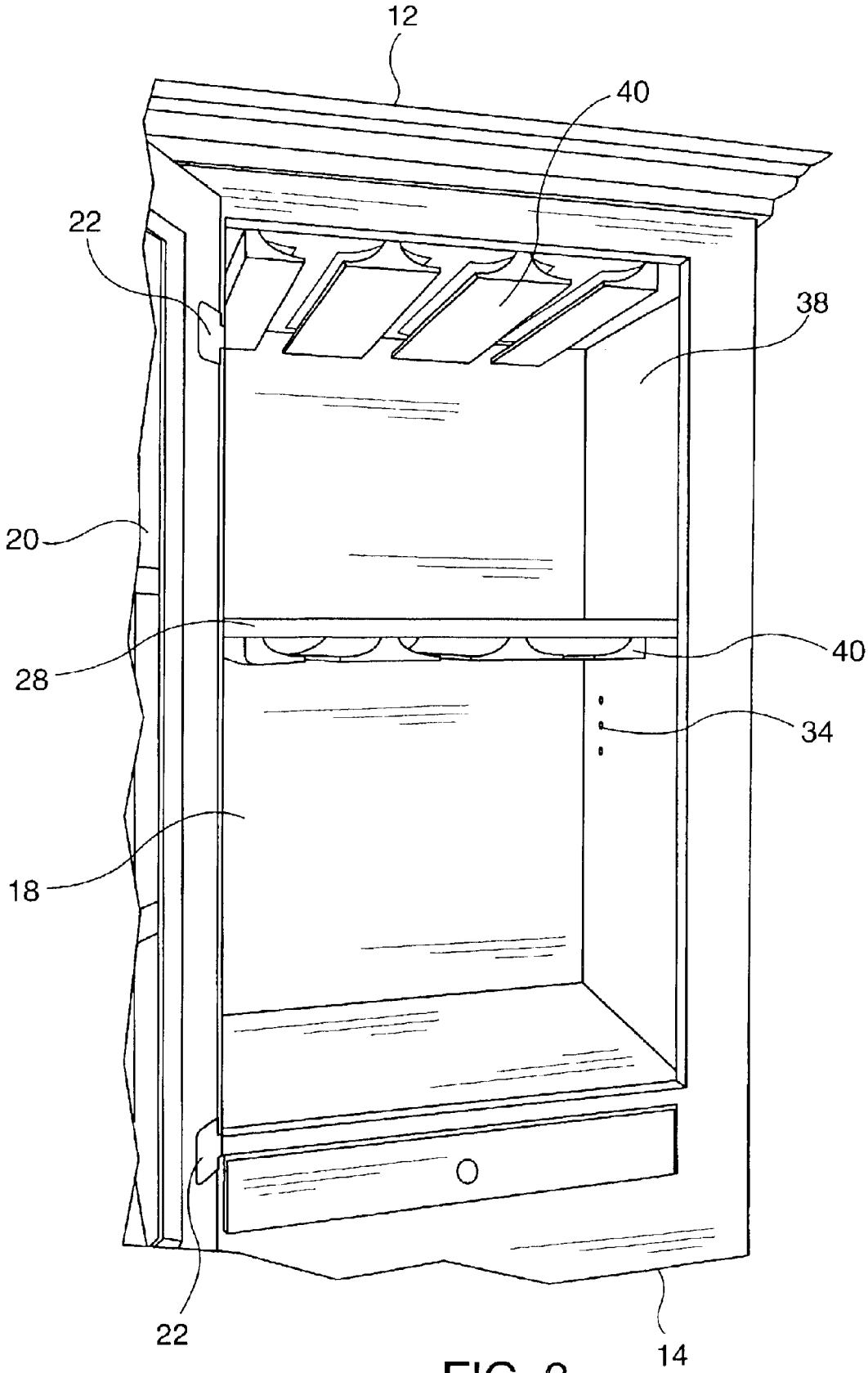
FIG. 3 is a pictorial view of the cabinet when opened, with its various glasses removed.
Figure 5:
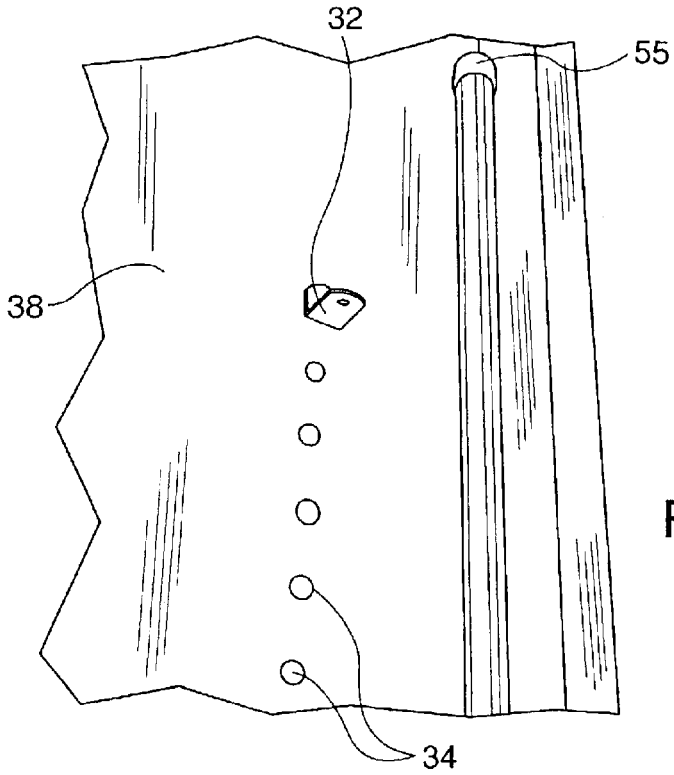
FIG. 5 is a pictorial view of the plastic encased rope-lighting for illuminating the inside of the cabinet.

Referring to FIGS. 1–3 of the Drawings, the glass display encasement of the invention includes a cabinet having enclosed top, bottom, side and rear walls 12, 14, 16 and 18 respectively. A see-through door 20 is hinged at 22, 24 for respectively closing the cabinet (FIG. 1) and for opening it (FIGS. 2, 3). Such door 20 may be composed of individual glass frames 26, in well known manner. A horizontally aligned shelf 28 extends between the side walls 16 within the cabinet as shown, although in larger configurations, additional horizontally aligned shelves may be added depending, for example, as to whether the cabinet is to sit upon a credenza, or rest directly upon a floor, either with or without furniture casters beneath. As shown in FIG. 5, the shelves may be adjusted upwardly or downwardly in height, by the selected placement of clips 32 within different apertures 34 along an inside surface 38 of the side walls 16.

Figure 4A:
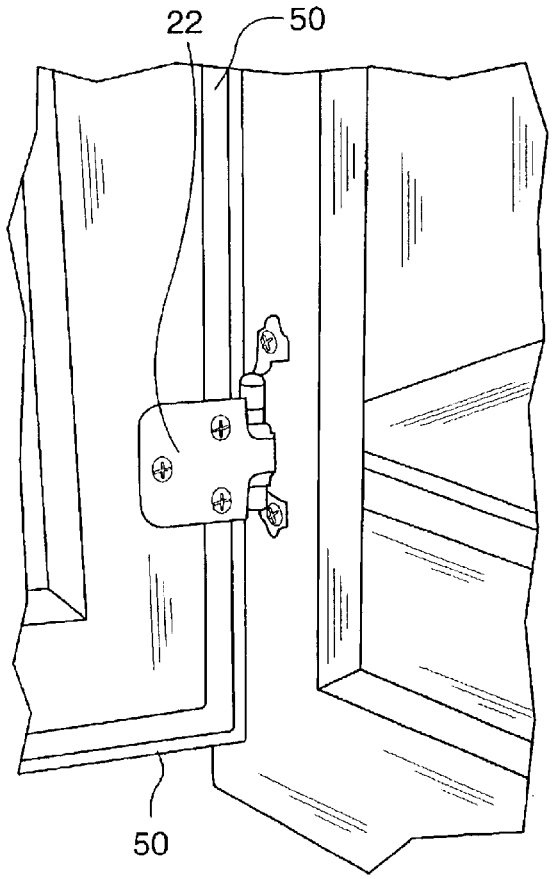
FIGS. 4A and 4B are helpful in an understanding of the automatically operating, self-closing hinges employed with the cabinet to automatically close the door entirely when manually closed by a user only part ways.
Figure 6:
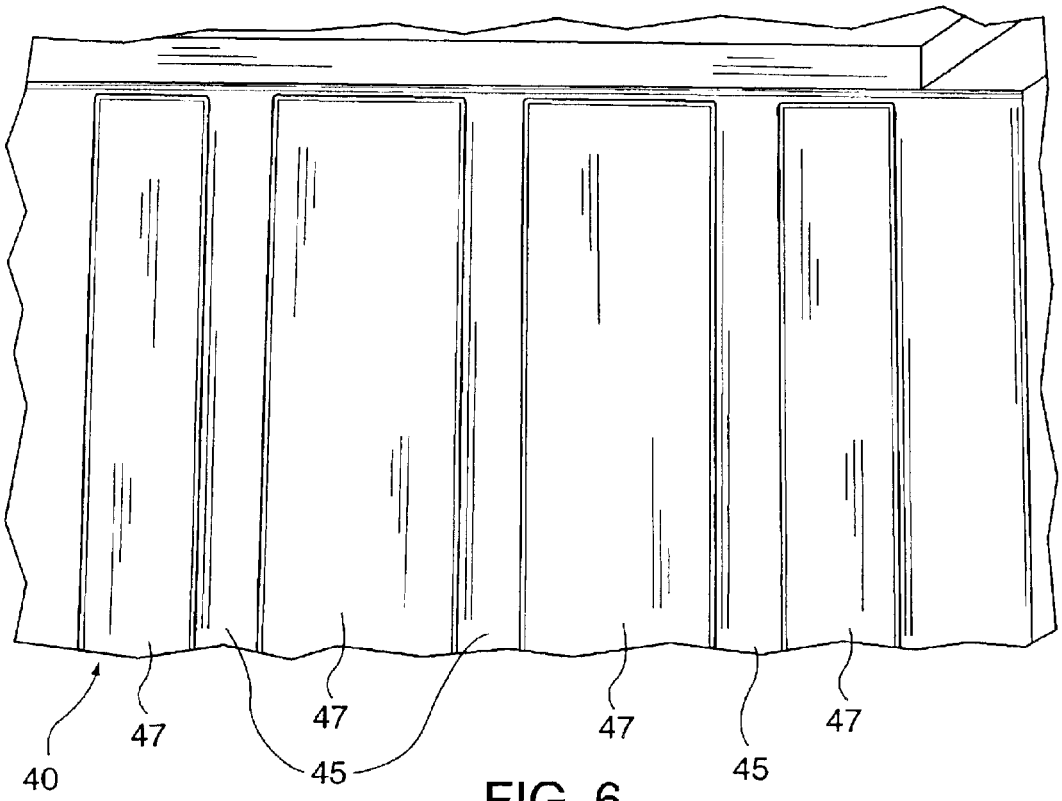
FIG. 6 is a pictorial view of the underside of the cabinet's top wall and of its various shelves for supporting the flanges of a succession of wine glasses in an inverted upside-down orientation.

First means, shown at 40 in FIGS. 2 and 3—and more clearly in FIG. 6—secure to an underside of the top wall 12 and to an underside of the shelf 28 for supporting the flange of a succession of wine glasses in an inverted upside-down orientation, as depicted in the various wine glass configurations of FIGS. 1 and 2. As will be understood from FIGS. 3 and 6, the stem and flange of each such glass slides within a slot 45 formed between downwardly extending frame pieces 47 in being held in place therebetween. A second means—for example, a felt piece compressible inwardly upon itself when closing the door 20—is shown at 50 secured to at least one edge surface of the door in sealing the cabinet against the entry of dust once the door is closed. As illustrated in FIGS. 2 and 4A, such felt composition extends on the inside of all four sides of the door 20.

As previously noted, one feature of the preferred embodiment is the illumination of the inside of the display and storage cabinet when the see-through door 20 is closed. Such illumination is provided in this embodiment by a plastic encased rope-lighting which extends both horizontally and vertically along the inside surface of the front wall of the cabinet. Such rope lighting is shown at 55 in FIG. 5—vertically on one side of the cabinet, although includable on the opposite side as well, in addition to being strung horizontally across either or both of the top and bottom walls in accordance with user preference. As will be appreciated, such rope-lighting is energized by means of an electrical cord and switch (not shown), inserted into a standard electrical outlet.

Figure 4B:
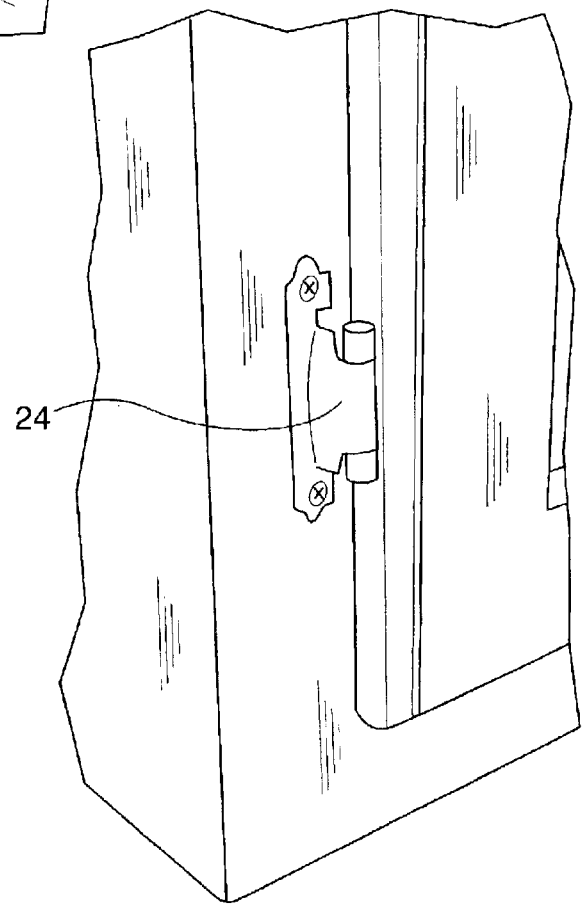

FIGS. 4A and 4B respectively show the type of hinges employed on the inside and outside of the door 20, as 22 and 24, for the purpose of automatically closing the door 20 when manually closed only part way, in providing a self-closing hinge in manner well known.

As will be appreciated, with the slot arrangement 45 at the underside of the top cabinet wall 12 and at the underside of each shelf 28 included, a succession of wine glasses can be displayed and stored from front to back in rows extending forwardly from the rear wall 16. With the four (4) different shapes of glasses displayed in FIGS. 1 and 2, like configurations of the wine glasses can extend front-to-back in the rows depicted, while two additional rows may likewise be provided for different glass configurations in accordance with the three sets of slottings 45 shown in FIG. 6. Thus, with the "one-shelf" arrangement of FIGS. 1 and 2, six rows of independently different shaped wine glasses may be stored and displayed.

Reference numeral 60 in FIG. 2 identifies an openable drawer in the cabinet with a pull handle 62 for storing various wine accessories as corkscrews, wax scoopers, bottle stoppers, etc. A similar type of pull handle 64 in FIG. 1 opens the door 20.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

We claim:

1. A drinking glass display encasement comprising:

a cabinet having enclosed top, bottom, side, front and rear walls;

a see-through door hinged to said cabinet for respectively closing and opening said cabinet;

at least one horizontally aligned shelf within said cabinet extending between said side walls thereof;

first means secured to an underside of said top wall and to an underside of said shelf for supporting the flange of a succession of drinking glasses from said top wall and from said shelf in an inverted upside-down orientation arranged in rows extending forwardly of said rear wall; and second means secured to at least one edge surface of said see-through door for sealing said cabinet against entry of dust when said door is closed;

wherein said see-through door is hinged to said cabinet by an automatically operating self-closing hinge closing said see-through door if left partially opened; and wherein said second means is of a felt composition inwardly compressible upon itself when closing said see-through door.

2. The glass display encasement of claim 1 wherein said first means is secured to an underside of said top wall and to an underside of said shelf for supporting the flange of a succession of wine glasses from both said top wall and said shelf.

3. The glass display encasement of claim 1, also including third means along an inside surface of said front wall for illuminating the inside of said cabinet from said front wall when said see-through door is closed.

4. The glass display encasement of claim 3 wherein said third means includes a plastic encased rope-lighting extending both horizontally and vertically along said inside surface of said front cabinet wall for illuminating the inside of said cabinet therefrom.

5. The glass display encasement of claim 1, also including a pull-out drawer extending forwardly of said rear cabinet wall between said side walls thereof at a location adjacent said bottom wall of said cabinet.

6. The glass display encasement of claim 1, including a plurality of vertically spaced, horizontally aligned shelves within said cabinet extending between said side walls thereof, and wherein said first means is secured to an underside of said top wall and to an underside of each of said shelves for supporting the flange of a succession of wine glasses both from said top wall and from each of said vertically spaced shelves.

7. The glass display encasement of claim 1 wherein said second means is secured at each edge surface of said see-through door.

* * * * *